US007634968B2

(12) United States Patent
Cornelius

(10) Patent No.: US 7,634,968 B2
(45) Date of Patent: Dec. 22, 2009

(54) PIVOTABLE BOARD PROVIDED WITH LEGS

(76) Inventor: Christian Cornelius, Karlshofstrasse 67, Stuttgart, Baden-Wuerttemberg (DE) 70599

( * ) Notice: Subject to any disclaimer, the term of this patent is extended or adjusted under 35 U.S.C. 154(b) by 0 days.

(21) Appl. No.: 10/491,260

(22) PCT Filed: Oct. 1, 2002

(86) PCT No.: PCT/EP02/10977

§ 371 (c)(1),
(2), (4) Date: Sep. 28, 2004

(87) PCT Pub. No.: WO03/030683

PCT Pub. Date: Apr. 17, 2003

(65) Prior Publication Data

US 2005/0039642 A1 Feb. 24, 2005

(30) Foreign Application Priority Data

Oct. 2, 2001 (DE) ..... 201 18 884

(51) Int. Cl.
*A47B 3/00* (2006.01)

(52) U.S. Cl. ..... 108/115; 248/188.6; 108/124

(58) Field of Classification Search ..... 108/115, 108/124, 132, 123, 128, 6, 50.01, 50.02; 248/188.6, 188.7, 188.1
See application file for complete search history.

(56) References Cited

U.S. PATENT DOCUMENTS

| | | | |
|---|---|---|---|
| 275,598 | A | 4/1883 | Crandall |
| 331,149 | A | 11/1885 | McClure |
| 346,795 | A | 8/1886 | Wilcox |
| 355,230 | A | 12/1886 | Taliaferro |
| 409,544 | A | 8/1889 | Ziegler |
| 571,980 | A | 11/1896 | Penfield |
| 598,077 | A | 2/1898 | Comee |
| 874,052 | A | 12/1907 | Cantwell |
| 881,556 | A | 3/1908 | Dehler |
| 948,905 | A | 2/1910 | Snyder |
| 1,200,071 | A | 10/1916 | Barter |
| 1,341,988 | A | 6/1920 | Koechlin |
| 1,735,162 | A | 11/1929 | Favour |
| 1,872,849 | A | 8/1932 | Townes |
| 1,912,096 | A | 5/1933 | Reuter |
| 1,939,459 | A | 12/1933 | Murray |

(Continued)

FOREIGN PATENT DOCUMENTS

| | | |
|---|---|---|
| CH | 681850 | 6/1993 |

(Continued)

OTHER PUBLICATIONS

Versteel, "TIM (Tables in Motion)," 5 page printout from web site, 2001.

(Continued)

*Primary Examiner*—José V Chen
(74) *Attorney, Agent, or Firm*—Quarles & Brady LLP

(57) ABSTRACT

A pivotable board with at least one leg is provided. The leg is connected to the board with a pivotable fitting. The pivotable fitting has a pivoting axis which is disposed in a slanted position with respect to the board and on which the leg or the board are pivotally mounted.

24 Claims, 6 Drawing Sheets

U.S. PATENT DOCUMENTS

| | | | | |
|---|---|---|---|---|
| 1,981,052 | A | | 11/1934 | Lehner |
| 2,174,952 | A | | 10/1939 | Spikinqs, Jr. |
| 2,397,405 | A | | 3/1946 | Burkeman |
| 2,520,469 | A | | 8/1950 | Mowrey |
| D164,295 | S | * | 8/1951 | Gierlich ..... D6/429 |
| 2,739,860 | A | | 3/1956 | Wilson |
| 2,741,868 | A | | 4/1956 | Saunders |
| 2,771,937 | A | | 11/1956 | Wilson |
| 2,791,477 | A | | 5/1957 | Wesbecher |
| 3,188,158 | A | | 6/1965 | Sanchez |
| 3,217,673 | A | | 11/1965 | Knoblock |
| 3,276,401 | A | | 10/1966 | Wilson et al. |
| 3,543,312 | A | | 12/1970 | Pofferi |
| 3,598,390 | A | | 8/1971 | Armitage |
| 3,618,704 | A | | 11/1971 | Smith Sr. |
| 3,641,946 | A | | 2/1972 | Charnay |
| 3,696,762 | A | | 10/1972 | Holdham |
| 3,785,299 | A | | 1/1974 | Caperton, Jr. |
| 3,786,766 | A | | 1/1974 | Chiariello |
| 3,796,169 | A | | 3/1974 | Bales et al. |
| 3,805,710 | A | | 4/1974 | Leshem |
| 3,861,325 | A | | 1/1975 | Bue et al. |
| 3,903,812 | A | | 9/1975 | Cowley |
| 3,951,233 | A | | 4/1976 | Meyers |
| 3,993,004 | A | | 11/1976 | Alme |
| 4,097,037 | A | | 6/1978 | Tardiff |
| 4,099,469 | A | | 7/1978 | Sahli |
| 4,108,083 | A | | 8/1978 | Espinosa |
| 4,136,622 | A | | 1/1979 | Bue et al. |
| 4,191,111 | A | | 3/1980 | Emmert |
| 4,196,675 | A | * | 4/1980 | Cook ..... 108/6 |
| 4,305,581 | A | | 12/1981 | Neuharth |
| 4,350,098 | A | | 9/1982 | Shirono |
| 4,372,631 | A | | 2/1983 | Leon |
| 4,383,486 | A | | 5/1983 | Reineman et al. |
| 4,387,650 | A | | 6/1983 | Pizzi |
| 4,643,105 | A | | 2/1987 | Baum |
| 4,645,162 | A | | 2/1987 | Roy et al. |
| 4,754,844 | A | | 7/1988 | Sutton |
| 4,773,337 | A | | 9/1988 | Ball |
| 4,815,395 | A | | 3/1989 | Trueg |
| 4,848,243 | A | | 7/1989 | Giordano |
| 4,879,954 | A | | 11/1989 | Sawamura et al. |
| 4,943,040 | A | | 7/1990 | Finstad et al. |
| 4,967,887 | A | | 11/1990 | Annacchino et al. |
| 4,986,195 | A | | 1/1991 | Diffrient |
| 4,986,501 | A | | 1/1991 | Simon |
| 5,056,780 | A | | 10/1991 | Tsang |
| 5,058,965 | A | | 10/1991 | Thorn |
| 5,117,986 | A | | 6/1992 | Lin |
| 5,119,903 | A | | 6/1992 | Ulshafer, Jr. |
| 5,121,697 | A | | 6/1992 | Baum et al. |
| 5,131,333 | A | | 7/1992 | Karasawa et al. |
| 5,154,127 | A | | 10/1992 | Booth |
| 5,161,766 | A | | 11/1992 | Arima |
| 5,174,225 | A | | 12/1992 | Reise et al. |
| 5,197,393 | A | | 3/1993 | Yeakle |
| 5,205,223 | A | | 4/1993 | Ball et al. |
| 5,337,657 | A | * | 8/1994 | Diffrient ..... 108/115 |
| 5,354,027 | A | | 10/1994 | Cox |
| 5,445,085 | A | | 8/1995 | Westerburgen |
| 5,528,997 | A | | 6/1996 | Miller |
| 5,657,703 | A | | 8/1997 | Johnson |
| 5,746,660 | A | | 5/1998 | Grover |
| 5,765,911 | A | | 6/1998 | Sorenson |
| 5,865,124 | A | | 2/1999 | Wroe |
| 5,927,214 | A | | 7/1999 | Schwartz et al. |
| 6,070,367 | A | | 6/2000 | Wagner et al. |
| 6,082,271 | A | | 7/2000 | Gosselin et al. |
| 6,082,838 | A | * | 7/2000 | Bissu-Palombo ..... 312/195 |
| 6,085,669 | A | | 7/2000 | Marchand et al. |
| 6,119,605 | A | | 9/2000 | Agee |
| 6,145,800 | A | | 11/2000 | Watkins |
| 6,164,217 | A | | 12/2000 | Prendergast |
| 6,170,407 | B1 | | 1/2001 | Hayward |
| 6,192,808 | B1 | | 2/2001 | Bue |
| D443,440 | S | * | 6/2001 | Deimen et al. ..... D6/480 |
| 6,314,892 | B1 | * | 11/2001 | Favini ..... 108/115 |
| 6,336,414 | B1 | * | 1/2002 | Stewart et al. ..... 108/50.02 |
| 6,354,227 | B1 | | 3/2002 | Feldpausch |
| 6,425,567 | B2 | | 7/2002 | Schutze |
| 6,550,405 | B2 | | 4/2003 | Gosselin |
| 6,553,918 | B2 | | 4/2003 | Bieza |
| 6,564,903 | B2 | | 5/2003 | Krajec |
| 6,575,103 | B1 | | 6/2003 | Holdredge et al. |
| 6,637,352 | B1 | | 10/2003 | Thode et al. |
| 6,662,731 | B2 | | 12/2003 | Teppo et al. |
| 6,681,704 | B1 | | 1/2004 | Brookhiser |
| 6,752,090 | B2 | * | 6/2004 | Schenker et al. ..... 108/115 |
| 6,817,303 | B2 | | 11/2004 | Gosselin |
| 6,845,723 | B2 | * | 1/2005 | Kottman et al. ..... 108/132 |
| 2003/0173472 | A1 | | 9/2003 | Liu |
| 2005/0039642 | A1 | | 2/2005 | Cornelius |
| 2005/0235886 | A1 | | 10/2005 | Koning et al. |
| 2005/0252426 | A1 | | 11/2005 | Blasen et al. |

FOREIGN PATENT DOCUMENTS

| | | |
|---|---|---|
| DE | 9417585.3 | 2/1995 |
| DE | 19837987 | 3/2000 |
| DE | 198 37 987 C2 | 9/2000 |
| DE | 100 38 223 | 2/2002 |
| DE | 10316246 | 12/2003 |
| EP | 0 392 817 | 10/1990 |
| EP | 0 453 401 | 1/1996 |
| EP | 1 308 109 | 5/2003 |
| EP | 1 159 887 | 10/2003 |
| JP | 55-100535 | 7/1980 |
| JP | 56-37619 | 9/1981 |
| JP | 11-18840 | 5/1989 |
| JP | 10-215952 | 8/1998 |
| JP | 11-56480 | 3/1999 |
| JP | 2000-60646 | 2/2000 |
| JP | 2002-223859 | 8/2002 |
| JP | 2003-507107 | 2/2003 |
| JP | 2003-180453 | 7/2003 |
| JP | 2003-339446 | 12/2003 |
| JP | 2004-267429 | 9/2004 |
| WO | WO 90/03132 | 4/1990 |
| WO | WO 01/13762 | 3/2001 |
| WO | WO 01/13762 A1 | 3/2001 |
| WO | WO 02/102193 | 12/2002 |
| WO | WO 03/030683 | 4/2003 |

OTHER PUBLICATIONS

Gibraltar, "Metal Table Bases and Legs," 2 page printout from web site, Oct. 6, 2005.
Fliptop, "The Flexible Solution," 4 page printout, not dated.

* cited by examiner

PIVOTABLE BOARD PROVIDED WITH LEGS

BACKGROUND OF THE INVENTION

The invention relates to a pivotable board provided with legs according to claim 1.

Said boards, preferably tabletops, can be used, for example, as folding tables, which can be found in many areas of application.

Herein it is desirable to tilt the board into a slanted position, in the same manner whereby a board is used as an easel or a drawing board, or to tilt the board into a vertical position in order to stack several tables into one another in a space-saving manner.

In this context it is known that one may not only tilt the board, but also turn the legs into a space-saving position so that they occupy as little space as possible in front of the vertically tilted board.

This has been achieved up to now by connecting the board and the legs with separate swiveling axes according to their separate movements towards a space-saving stacking position. In every case, tabletop and legs and/or their supporting structures must each be individually positioned into their desired end-positions.

Such a folding table is, for instance, known by DE 9417585 U1. However, its handling is rather complicated. For instance, in order to turn the legs or the related support structure into a desired end-position, the exact horizontal position of the board to be tilted must first be manually secured; the board must then be manually put into a vertical position.

To swivel this board into a working position, it must first be manually turned into a horizontal position and kept there manually until the legs or their related support structure can be securely turned towards their supporting end-position. However, this design hardly offers a convenient way of handling a fliptop table.

The same might be said about the table known under DE 198 37 987 A1. Its coupling turns the vertically pivoted leg and/or their support part together with the horizontally pivoted tabletop. Such a mechanism not only requires a lot of force but, in order to be effected, it needs casters on a flat, horizontal ground. Moreover, its construction is complicated, expensive and mechanically susceptible and, therefore, unsatisfactory.

The aim of the present invention, by contrast, is to create a board with leg or support structure of said genre with as little constructive effort as possible and, thus, to offer simple and comfortable handling, in order to swivel the board and legs simultaneously. This task is solved with a board characterized by claim 1.

SUMMARY OF THE PRESENT INVENTION

By means of this construction, a simple yet very effective way of coupling the respective movements of the horizontally swiveling board and the vertically swiveling legs is achieved.

The characteristic of the present invention is that the pivot axis guides the board, as well as the associated leg, by means of an axle oriented in space.

The pivot axis is conveniently mounted onto the board. It can generally also be fixed onto the leg. In every instance, board and leg pivot around a definite spatially oriented axis.

The invention not only relates to the specific use in folding tables, but is also highly suitable for easels, displays, blackboards, reading/mounting supports (i.e. holding devices) whenever simple swiveling of a board is needed to be easily clamped into various oblique positions. This might be done by an arresting facility or tooth-clutch integrated together with the swiveling elements. It is also conceivable to integrate a continuous adjustability, whereby the desired oblique position would then be fixed by a brake facility or alike.

Furthermore, the invention can apply to a table with only one leg. In this case, the pedestal is preferably built by three side arms.

The arms can be equipped with casters or gliders, which allow easy movement on the ground around a basically vertical axis. Whilst rotating on the ground, the pedestal moves from a position that offers a horizontal board maximum stability to a position that occupies minimal space in front of a vertical board and on the ground.

The latter case, wherein the board is vertically positioned, allows for a very efficient space-saving storage of many similarly designed tables stacking into one another.

In the present invention's most beneficial formation, a pivot axis is provided in shape of a funneled case that is fixedly mounted onto the board and a conical member supported therein. The conical member is connected to the leg. The shared central longitudinal axis, which also builds the axis of symmetry, is spatially slanted and thereby positioned with respect to the board.

In a board provided with two legs, both axes of symmetry are spatially oriented towards one another, so that when the board is swiveled from a horizontal into a vertical position both arms or pedestals positioned in front of the board will rotate towards each other. In the board's exact vertical and/or horizontal position the post of a leg structure is preferably vertical.

It is very beneficial but also easy to make the case and its mount for the board into something decorative, especially by using transparent or decorative boards, since tabletops are known to often interfere with a table's overall impression.

Instead of forming a funneled case and conical member the pivot axis can be a formation of a bolt hinged onto the leg and connected with a frame or beam fixedly mounted onto the board. The important characteristic is a spatially slanted position of the pivot axle's slanted position with respect to the surface and the edges, for example, of a tabletop.

Further advantageous formations of the present invention are specified in the claims.

An exemplary embodiment of the invention is described by the following drawings.

DETAILED DESCRIPTION OF THE DRAWINGS

Figure 1:
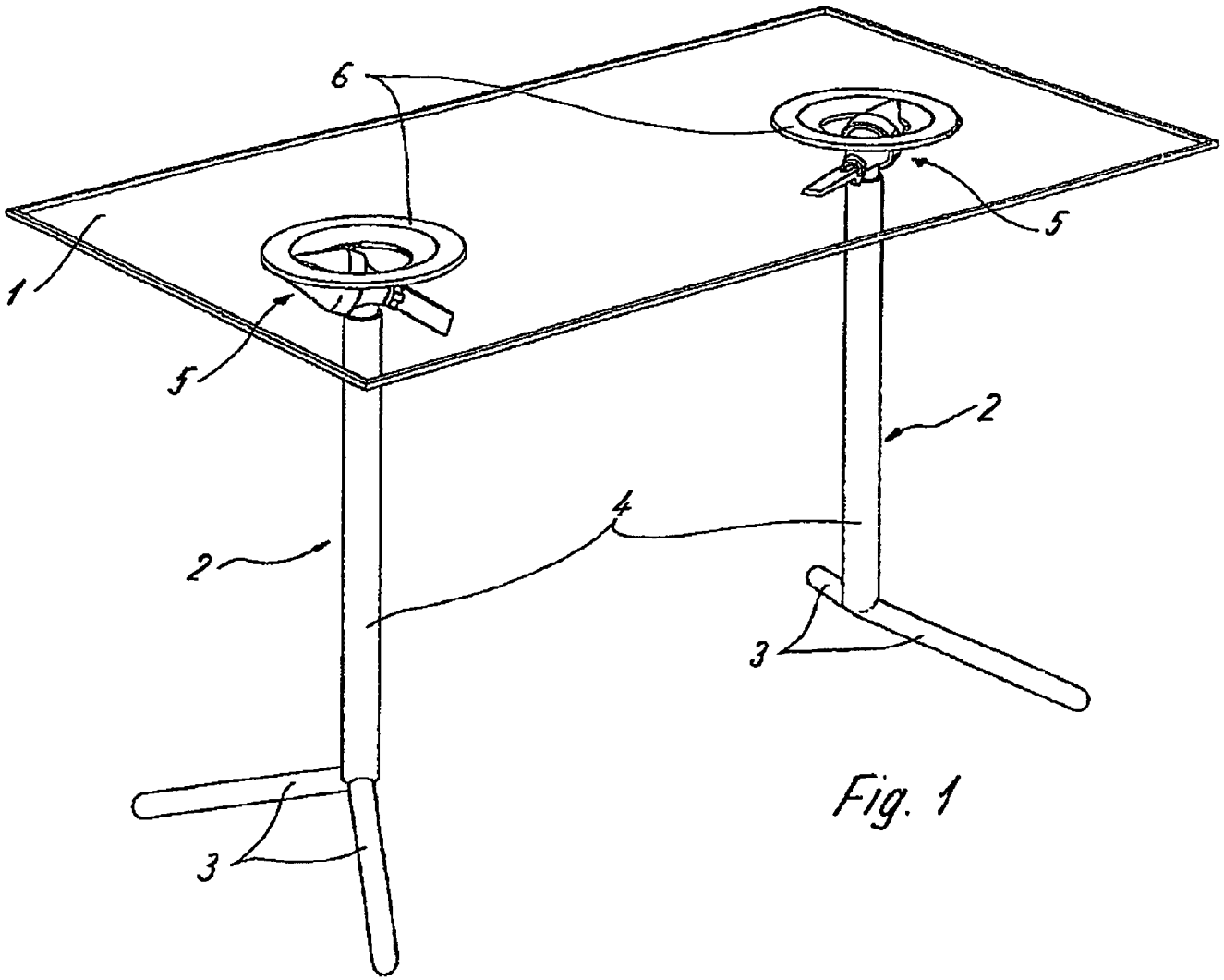
FIG. 1 shows a folding table according to the invention in perspective view.
Figure 2:
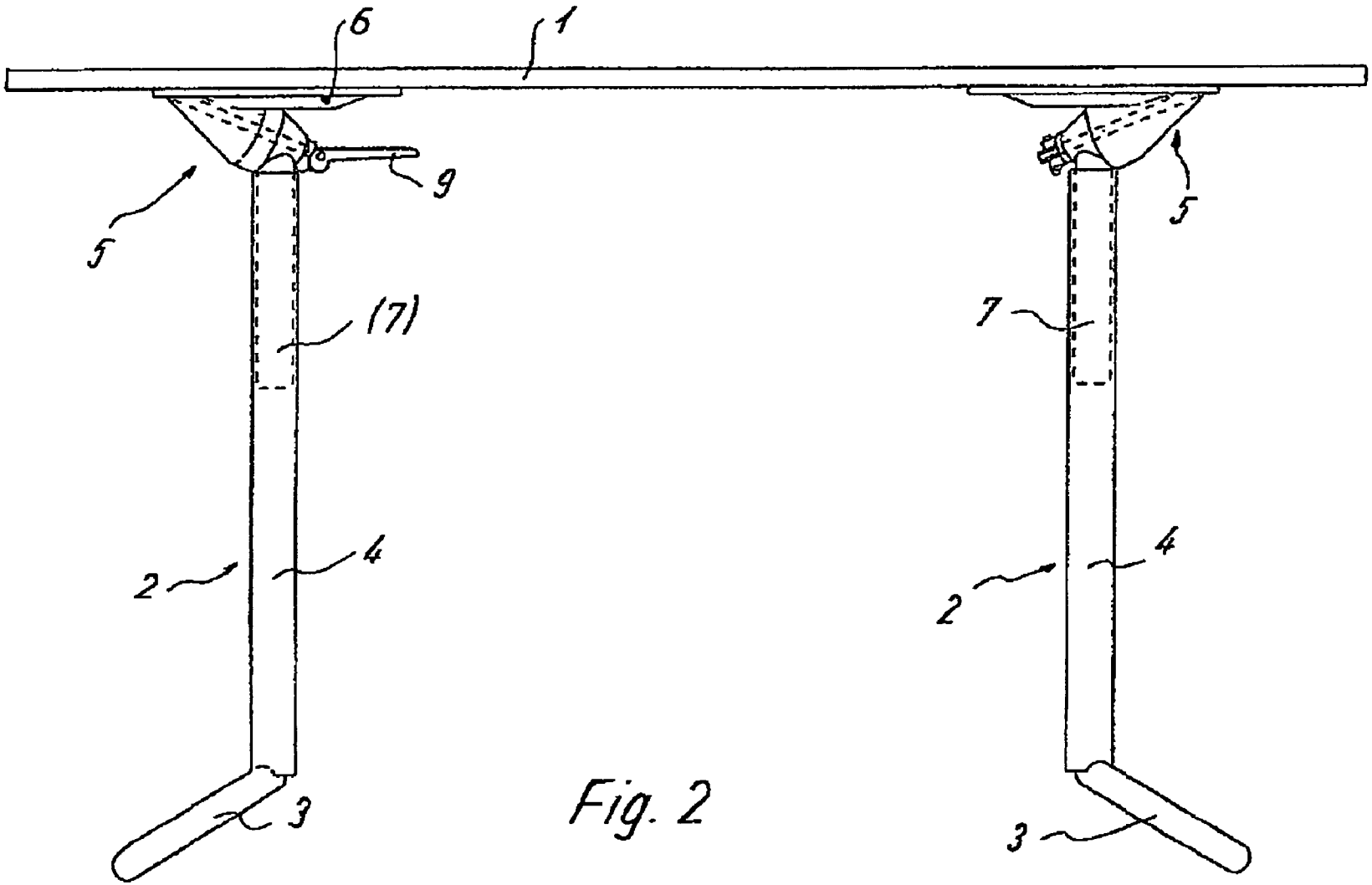
FIG. 2 shows the folding table in front view.
Figure 3:
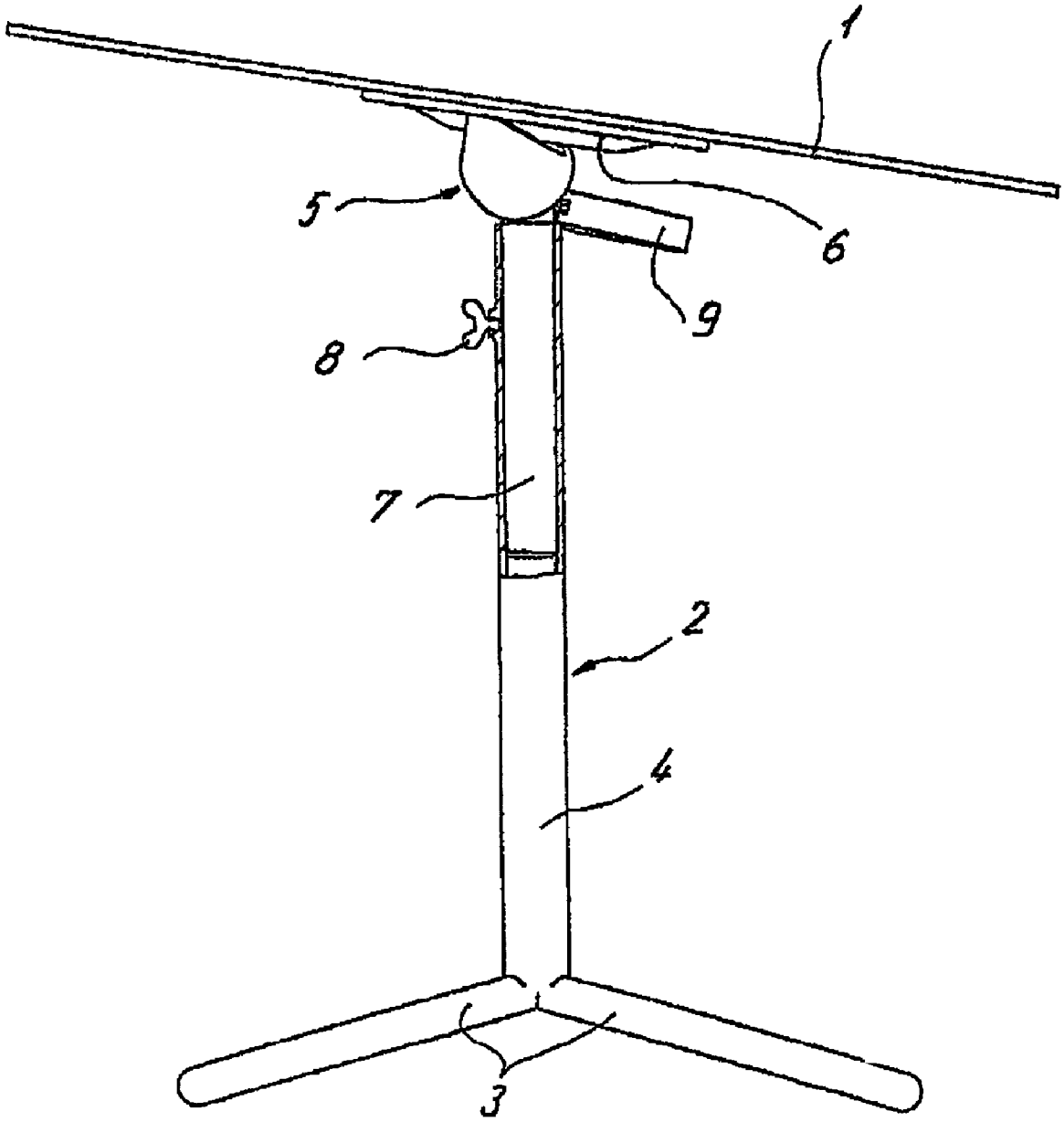
FIG. 3 shows the folding table in side view with its board in a slanted work position.
Figure 4:
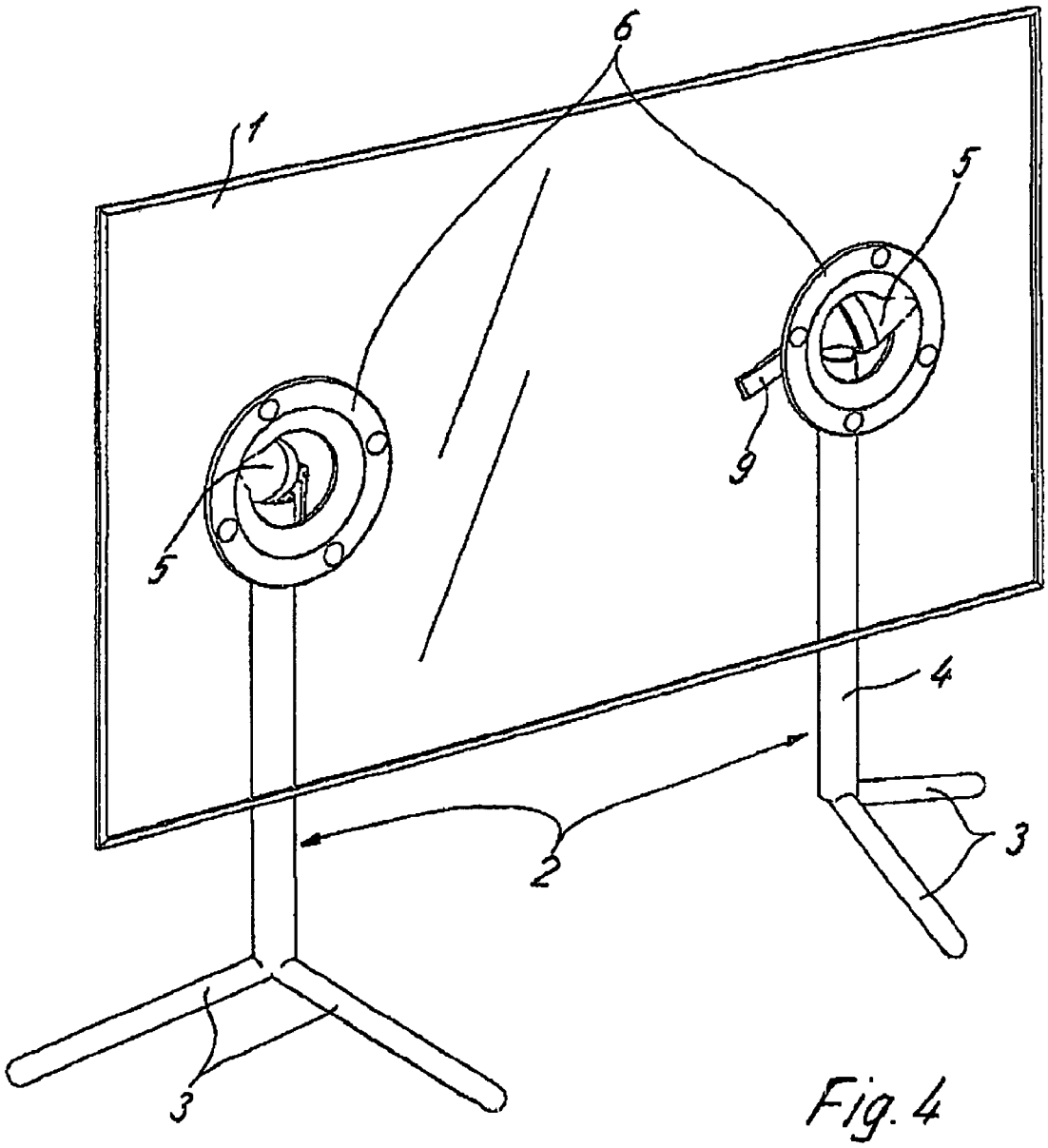
FIG. 4 shows the folding table in a perspective view with its board in a vertical storage position.

FIGS. 1-4 show a folding table in a basic configuration with a board 1 built as a transparent tabletop and two legs 2, which are connected by means of pivotable fittings 5 to the board 1 through which board 1, as well as leg 2, dependently move from a horizontally working position, as shown in FIG. 1 and FIG. 2, into a storage position according to FIG. 4. The latter figure shows board 1 in a vertical position and the legs 2 pivotally moved inwards so that they occupy as little space as possible in front of board 1 and on the ground.

Each leg 2 consists of a tubular post 4 with two cross bars 3 extending radially from its bottom end towards the ground.

Each pivotable fitting 5 is attached to the bottom side of the board 1 by a mounting plate 6 and led into the tubular post 4 by means of a tubular connector 7 that is tightened through a thumb-screw 8 thus connecting leg 2 in a height-adjustable and torsionally-stiff manner.

FIG. 3 shows an inclined position of board 1, most beneficial, for example, when used as a working platform.

Figure 6:
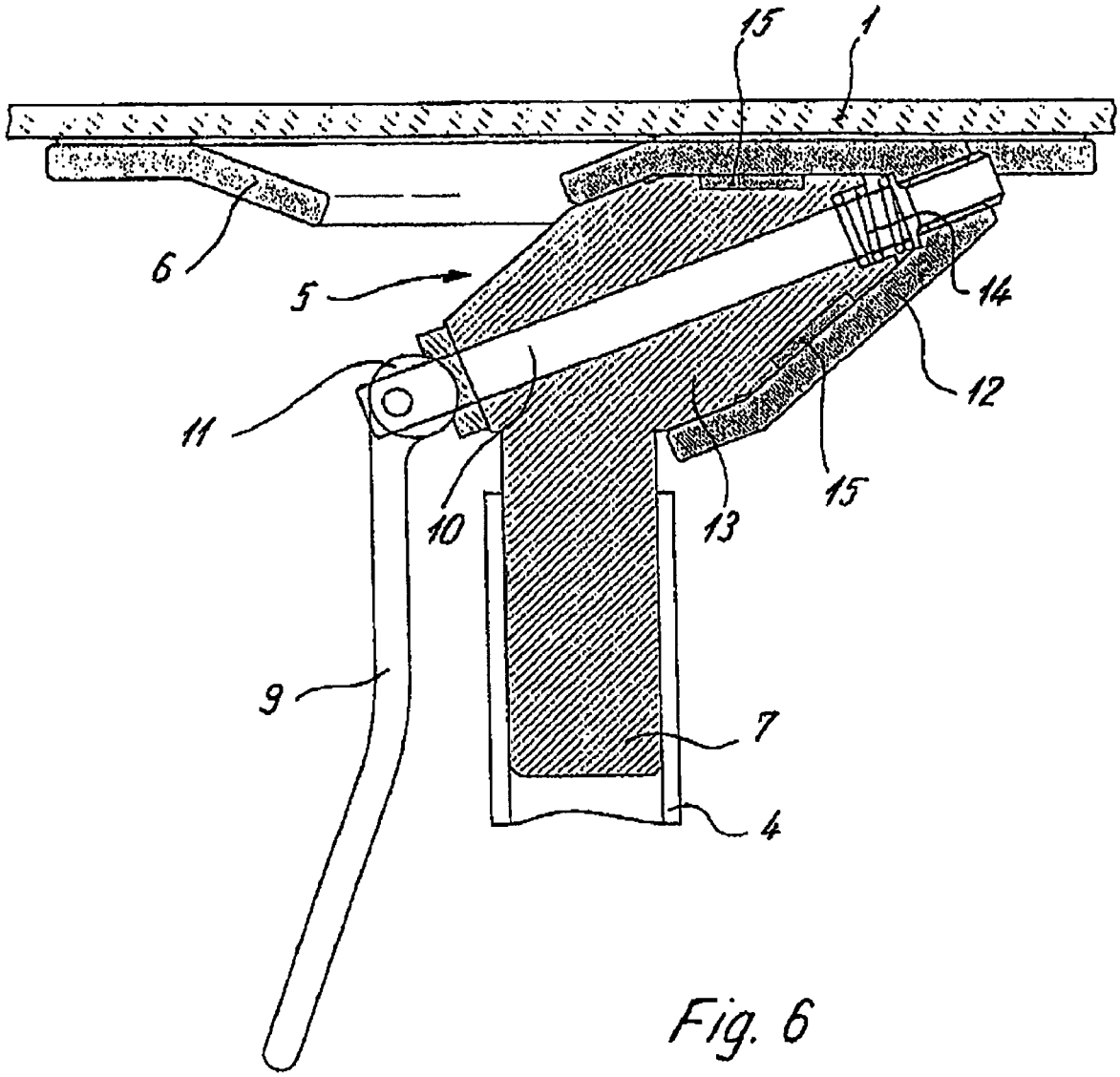
FIG. 6 shows a fragmentary sectional view of the pivot mechanism from the folding table.

As shown evidently in FIG. 6, the pivotable fitting 5 possesses in this present formation a funneled case 12, which is fixedly joined to the mounting plate 6. The funneled case 12 contains a cone-shaped area tapering towards the tabletop. A conical member 13 is supported herein that is joined to the already described tubular connector 7 inserting into the tubular post 4.

Case 12 and conical member 13 share a longitudinal axis that is spatially slanted with respect to the board, thus creating a hinge that swivels board 1 as well as leg 2. By doing so, both conical members 13 rotate in the fixedly mounted cases 12 in a way that the opposing cross bars 3 swivel towards one another into an end position, as shown in FIG. 4 and FIG. 5.

Figure 5:
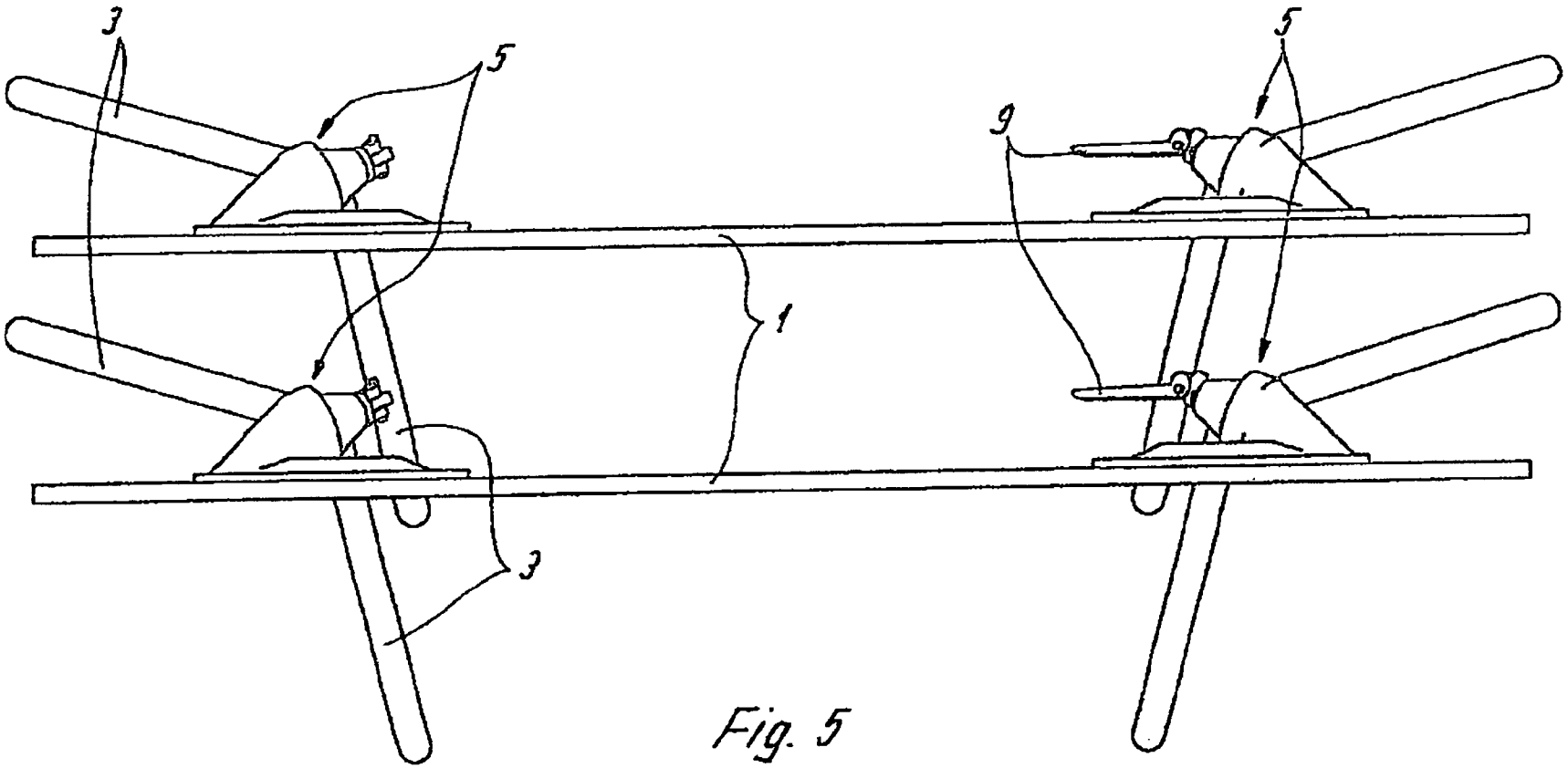
FIG. 5 shows a top view of two folding tables with their boards in a vertical storage position stacked in one another.

FIG. 5 illustrates how the cross bars 3 orient themselves and thereby construct a folding table allowing other similarly designed tables to nest into one another as close as possible.

The conical member 13 of the pivotable fitting 5 in FIG. 6 is pivotally supported by a clamping bolt 10, which is screwed into the tapered part closest to board 1 of case 12. In this part, a compression spring 14 is guided onto the clamping bolt 10, pressing against the case 12 and the conical portion 13.

A lever 9 is rotatably connected to the end of the clamping bolt 10, which lies opposite the spring 14. In the area wherein it attaches itself to the clamping bolt 10, the lever 9 contains a lobe 11 that can press against the conical member 13.

In order to clamp the conical member 13 into the case 12 to obtain sturdy fixed positions of board 1 and leg 2, the lever 9 is to be rotated with its lobe 11 pressing against the conical member 13. The conical circumferential surface of the conical member 13 simultaneously presses against the inner surface of case 12, thereby achieving a frictional grip. So as to adapt to the necessary friction between conical member 13 and case 12, brake pads 15 are provided onto the conical member 13. These pads also protect conical member 13 and case 12 from unintended abrasion and allow for better adjustability of frictional moments whilst increasing or decreasing pressure with lever 9.

To release the frictional contact needed to swivel board 1, the lever 9 will be activated to release lobe 11 from its clamping position. The pressure spring 14 helps to axially move the conical member 13 led onto the clamping bolt 10 away from contact with case 12.

This embodiment of pivotable fitting 5 offers a continuously adjustable tilt-position of the board 1 with respect to the ground while, as said before, legs 2 simultaneously move around an almost vertical axis.

The ensuing movement of the legs 2 on the ground is basically effected by the fact that the pivot axis changes spatial position whilst tilting the board 1 on the ground as a guiding surface. The pivot axis is created herein by case 12 and conical portion 13. Moreover, for each leg 2, the swivel angle adapts to the floor's unevenness and thereby offers the table great stability and sturdiness.

What is claimed is:

1. A pivotable board comprising:

a board having opposing surfaces;

at least one leg connected to one surface of the board through a pivotable fitting having a pivot axis extending along the pivotable fitting; and wherein the pivot axis is slanted with respect to the one surface of the board to hinge the leg;

wherein movement of the board between a working position and a stored position causes movement of the at least one leg about the pivot axis.

2. The board of claim 1, wherein the board includes a plurality of side surfaces extending between the opposing surfaces to form a plurality of corners thereabout and wherein the pivot axis is slanted with respect to the plurality of corners.

3. The board of claim 1, wherein the pivot axis is in a fixed position relative to the board.

4. The board of claim 3, wherein the leg is hinged about the pivot axis.

5. The board of claim 1, wherein:

the pivotable fitting includes a funneled case having a narrowing taper extending away from the board and a conical element supported therein; and the pivot axis is aligned along a longitudinal axis of the pivotable fitting.

6. The board of claim 5, wherein the funneled case is fixedly mounted to the board and the conical element is connected to the leg.

7. The board of claim 5, wherein the funneled case and the conical element share a common longitudinal centerline.

8. The board of claim 5, wherein the conical element is connected to the leg with a tubular connector.

9. The board of claim 8, wherein the tubular connector is fixed to a tubular post of the leg through at least one thumb-screw.

10. The board of claim 5, further comprising a clamping bolt extending through the conical element along the pivot axis and, wherein the conical element is at least partially covered by a case to fix the conical element to the board at an end of the case and create a lever that presses the conical element against an inner surface of the case.

11. The board of claim 10, wherein the clamping bolt is screwed into the case.

12. The board of claim 10, further comprising a pressure spring having two opposing ends that surrounds the clamping bolt and, wherein one side of the pressure spring presses against the conical element and the other side of the pressure spring presses against the case.

13. The board of claim 10, wherein the lever includes a lobe configured to press the conical element against the case when the lever is turned.

14. The board of claim 5, wherein the conical element includes friction pads adjacent to an inner surface of the case to provide a frictional surface between the conical element and case to secure the board in a particular pivoted position.

15. The board of claim 1, wherein the pivotable fitting is connected to a mount attached to the board.

16. The board of claim 1, wherein the pivotable fitting provides for adjustment of the board about the pivot axis at any position between the working position and the stored position.

17. A board of claim 1, wherein the pivotable fitting is adjustable with an arresting facility.

18. The board of claim 1 wherein the leg includes casters.

19. The board of claim 1, wherein the board forms a tabletop.

20. The board of claim 1, further comprising a second leg connected to the board through a second pivotable fitting having a second pivot axis and, wherein the second pivot axis is slanted with respect to the one surface of the board to hinge and rotate the second leg.

21. A board comprising:

a worksurface;

at least one leg engaged at a first end with the worksurface to support the worksurface;

at least one foot extending from a second end of the at least one leg;

a pivotable fitting and in a direction slanted with respect to at least one of the worksurface and the at least one leg defining a pivot axis extending along the pivotable fitting and securing the at least one leg to the worksurface to allow the worksurface to be rotated along a first path between a first position where the worksurface is substantially perpendicular to the at least one leg and a second position where the worksurface is substantially parallel with the at least one leg; and wherein the pivotable fitting is configured such that rotation of the worksurface along the first path between the first position and the second position substantially simultaneously rotates the at least one foot about the pivot axis and along a second path transverse to the first path.

22. The board of claim 21 wherein the worksurface forms a plane extending in two directions and wherein the pivotable fitting is configured to automatically rotate the at least one foot to extend along a first of the two directions when the worksurface is in the first position and a second of the two directions when the worksurface is in the second position.

23. A board comprising:

a worksurface;

at least two legs engaged with the worksurface at a spaced interval to support the worksurface;

at least one foot extending from a second end of each of the at least two legs;

a pivotable fitting securing each of the at least two legs to the worksurface and forming a pivot axis extending along the pivotable fitting and oriented in a direction that is slanted with respect to at least one of the worksurface and a respective leg to allow the worksurface to be rotated along a first path between a first position where the worksurface is substantially perpendicular to each of the at least two legs and a second position where the worksurface is substantially parallel with each of the at least two legs; and wherein the orientation of the pivot axis allows the at least one foot of each of the at least two legs to be rotated along a second path transverse to the first path in response to rotation of the worksurface along the first path.

24. The board of claim 23 wherein the worksurface forms a plane extending in two directions and wherein the pivotable fitting is configured to automatically rotate the at least one foot to extend along a first of the two directions when the worksurface is in the first position and a second of the two directions when the worksurface is in the second position.

* * * * *